US007741943B2

(12) United States Patent
Fouquet et al.

(10) Patent No.: US 7,741,943 B2
(45) Date of Patent: Jun. 22, 2010

(54) MINIATURE TRANSFORMERS ADAPTED FOR USE IN GALVANIC ISOLATORS AND THE LIKE

(75) Inventors: Julie E. Fouquet, Portola Valley, CA (US); Calvin B. Ward, Castro Valley, CA (US)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 12/392,978

(22) Filed: Feb. 25, 2009

(65) Prior Publication Data

US 2009/0153283 A1 Jun. 18, 2009

Related U.S. Application Data

(62) Division of application No. 11/747,092, filed on May 10, 2007.

(51) Int. Cl.
*H01F 5/00* (2006.01)

(52) U.S. Cl. ..... 336/200

(58) Field of Classification Search ..... 336/65, 336/83, 200, 206–208, 223, 232; 257/531
See application file for complete search history.

(56) References Cited

U.S. PATENT DOCUMENTS

| | | | | |
|---|---|---|---|---|
| 4,027,152 | A | | 5/1977 | Brown et al. |
| 4,494,100 | A | | 1/1985 | Stengel et al. |
| 4,541,894 | A | | 9/1985 | Cassat |
| 5,312,674 | A | | 5/1994 | Haertling et al. |
| 5,363,081 | A | | 11/1994 | Bando et al. |
| 5,420,558 | A | * | 5/1995 | Ito et al. ..... 336/200 |
| 5,597,979 | A | | 1/1997 | Courtney et al. |
| 5,693,871 | A | | 12/1997 | Stout et al. |
| 5,754,088 | A | | 5/1998 | Fletcher et al. |
| 5,825,259 | A | | 10/1998 | Harpham |
| 5,952,849 | A | | 9/1999 | Haigh |
| 6,167,475 | A | | 12/2000 | Carr |
| 6,175,293 | B1 | | 1/2001 | Hasegawa et al. |
| 6,215,377 | B1 | | 4/2001 | Douriet et al. |

(Continued)

FOREIGN PATENT DOCUMENTS

CN 1180277 6/1996

(Continued)

OTHER PUBLICATIONS

Oljaca, Miroslav , "Interfacting the ADS1202 Modulator with a Pulse Transformer In Galvanically Isolated Systems", *SBAA096* Jun. 2003, 22 pages.

(Continued)

*Primary Examiner*—Tuyen Nguyen

(57) ABSTRACT

A component coil for constructing transformers and the transformer constructed therefrom are disclosed. The component coil includes a substrate having an insulating layer of material having top and bottom surfaces. First and second traces are included on the top and bottom surfaces. Each trace includes a spiral conductor. The inner ends of the spiral conductors are connected by a conductor that passes through the insulating layer. The first and second spiral conductors are oriented such that magnetic fields generated by the first and second spiral conductors have components perpendicular to the top surface and in the same direction. The component coils can be used to construct a power transformer or a galvanic isolator.

5 Claims, 14 Drawing Sheets

U.S. PATENT DOCUMENTS

| | | | | |
|---|---|---|---|---|
| 6,255,714 | B1 | 7/2001 | Kossives et al. | |
| 6,307,457 | B1 | 10/2001 | Wissink et al. | |
| 6,320,532 | B1 | 11/2001 | Diede | |
| 6,404,317 | B1 * | 6/2002 | Mizoguchi et al. | 336/200 |
| 6,489,850 | B2 | 12/2002 | Heineke et al. | |
| 6,501,364 | B1 | 12/2002 | Hui et al. | |
| 6,525,566 | B2 | 2/2003 | Haigh et al. | |
| 6,538,313 | B1 | 3/2003 | Smith | |
| 6,574,091 | B2 | 6/2003 | Heineke et al. | |
| 6,661,079 | B1 | 12/2003 | Bikulcius et al. | |
| 6,856,226 | B2 | 2/2005 | Gardner | |
| 6,867,678 | B2 * | 3/2005 | Yang | 336/200 |
| 6,870,456 | B2 | 3/2005 | Gardner | |
| 6,873,065 | B2 | 3/2005 | Haigh et al. | |
| 6,891,461 | B2 | 5/2005 | Gardner | |
| 6,903,578 | B2 | 6/2005 | Haigh et al. | |
| 6,922,080 | B2 | 7/2005 | Haigh et al. | |
| 6,943,658 | B2 | 9/2005 | Gardner | |
| 6,944,009 | B2 | 9/2005 | Nguyen et al. | |
| 7,064,442 | B1 | 6/2006 | Lane et al. | |
| 7,170,807 | B2 | 1/2007 | Fazan et al. | |
| 7,171,739 | B2 | 2/2007 | Yang et al. | |
| 7,425,787 | B2 | 9/2008 | Larson, III | |
| 7,436,282 | B2 | 10/2008 | Whittaker et al. | |
| 7,460,604 | B2 | 12/2008 | Dupuis | |
| 2005/0057277 | A1 | 3/2005 | Chen et al. | |
| 2005/0077993 | A1 | 4/2005 | Kanno et al. | |
| 2005/0133249 | A1 | 6/2005 | Fujii | |
| 2005/0272378 | A1 | 12/2005 | Dupuis | |
| 2006/0028313 | A1 | 2/2006 | Strzalkowski et al. | |
| 2006/0095639 | A1 | 5/2006 | Guenin et al. | |
| 2006/0152322 | A1 | 7/2006 | Whittaker et al. | |
| 2006/0170527 | A1 | 8/2006 | Braunisch | |
| 2006/0176137 | A1 | 8/2006 | Sato et al. | |
| 2006/0220775 | A1 | 10/2006 | Ishikawa | |
| 2007/0085447 | A1 | 4/2007 | Larson, III | |
| 2007/0085632 | A1 | 4/2007 | Larson, III et al. | |
| 2007/0086274 | A1 | 4/2007 | Nishimura et al. | |
| 2007/0133933 | A1 | 6/2007 | Yoon | |
| 2007/0281394 | A1 | 12/2007 | Kawabe et al. | |
| 2007/0290784 | A1 | 12/2007 | Nesse et al. | |
| 2008/0007382 | A1 | 1/2008 | Snyder | |
| 2008/0051158 | A1 | 2/2008 | Male et al. | |
| 2008/0061631 | A1 | 3/2008 | Fouquet et al. | |
| 2008/0174396 | A1 | 7/2008 | Choi et al. | |
| 2008/0198904 | A1 | 8/2008 | Chang | |
| 2008/0278275 | A1 | 11/2008 | Fouquet et al. | |
| 2008/0311862 | A1 | 12/2008 | Spina et al. | |

FOREIGN PATENT DOCUMENTS

| | | |
|---|---|---|
| EP | 1309033 | 5/2003 |
| GB | 2403072 | 6/2004 |
| WO | WO-9734349 | 3/1997 |
| WO | WO-2005/001928 | 6/2005 |

OTHER PUBLICATIONS

U.S. Appl. No. 11/264,956, filed Nov. 1, 2005, Guenin et al.

U.S. Appl. No. 11/512,034, filed Aug. 28, 2006, Fouquet et al.

U.S. Appl. No. 11/747,092, filed May 10, 2007, Fouquet et al.

"Advanced Circuit Materials, High Frequency Laminates and Flexible Circuit Materials", *Rogers Corporation*, www.rogerscorporation.com/mwu/translations/prod.htm Mar. 2008.

"Texas Instruments Dual Digital Isolators", *SLLS755E* Jul. 2007.

Analog Devices, Inc., , "iCoupler Digital Isolator ADuM1100 Data Sheet,", *Rev F* 2006.

Chen, Baoxing , "iCoupler Products with iso Power Technology", "*Signal and Power Transfer Across Isolation Barrier Using Microtransformers" Analog Devices* 2006.

Electronic Design "Planar Transformers make Maximum Use of Precious Board Space", *Penton Media, Inc., ED Online ID #7647* Mar. 9, 1998.

Krupka, J. et al., "Measurements of Permittivity, Loss Dielectric Tangent, and Resistivity of Float-Zone Silicon at Microwave Frequencies", *IEEE Abstract Microwave Theory and Techniques, IEEE Transaction on vol. 54, Issue 11* Nov. 2006, 3995-4001.

Myers, John et al., "GMR Isolators", *Nonvalatile Electronics, Inc.* 1998.

Yang, Ru-Yuan , "Loss Characteristics of Silicon Substrate with Different Resistivities", *Microwave and Optical Technology Letters, vol. 48, No. 9* Sep. 2006.

"Allflex Flexible Printed Circuits", *Design Guide* Undated.

Avago Technologies, "ACCL-9xxx 3.3V/5V High Speed CMOS Capacitive Isolator", *Preliminary Datasheet* Undated.

Payton Group International, "Off the Shelf SMT Planar Transformers", Undated.

* cited by examiner

300

MINIATURE TRANSFORMERS ADAPTED FOR USE IN GALVANIC ISOLATORS AND THE LIKE

CROSS-REFERENCED TO RELATED APPLICATION

This is a divisional application of co-pending application Ser. No. 11/747,092, filed on May 10, 2007, the entire disclosure of which is incorporated herein by reference.

BACKGROUND OF THE INVENTION

Transformers are often used to transfer information or power between circuits that are operating at different voltages or under different noise conditions. In many circuit arrangements, a logic signal must be transmitted between two circuits that must otherwise be electrically isolated from one another. For example, the transmitting circuit could utilize high internal voltages that would present a hazard to the receiving circuit or individuals in contact with that circuit. In the more general case, the isolating circuit must provide both voltage and noise isolation across an insulating barrier.

One type of galvanic isolator utilizes a transformer based system to isolate the two circuits. The sending circuit is connected to the primary coil of the transformer and the receiving circuit is connected to the secondary coil. The information is transferred by modulating the magnetic field generated in the primary coil. In this arrangement, the sending and receiving circuits can utilize entirely different power supplies and grounds and operate at different signal voltage levels. Typically, the transmitter and the two windings are constructed on a first semiconductor chip and the receiver is constructed on a separate chip that is connected to the first chip by wire bonds or the like. The two transformer windings are, typically, deposited over or near the drive circuits on the first chip by patterning two of the metal layers that are typically provided in conventional semiconductor fabrication processes. Alternatively, the coils may be fabricated on a different chip.

If the transformer coils are fabricated on the transmitter chip, the size of the transmitter chip is set by the size of the transformer coils, which typically require a significant area of silicon compared to the drive circuitry. Alternatively, if the coils are fabricated on the receiver chip or a separate chip, the coils will still require a significant area of silicon on those chips. The cost of the semiconductor substrate is a significant fraction of the cost of the isolator. This is a particularly significant problem when large coils are required to provide the coupling between the transmitter and receiver. In addition, many applications require multiple independent galvanic isolators on a single substrate. Cross-talk between the isolators constructed on silicon substrates using conventional semiconductor fabrication techniques is difficult to block in a cost-effective manner because of fringe fields generated by one coil being coupled to an adjacent coil. If the chips are separated by a sufficient distance on the silicon substrate, the cost of the wasted silicon becomes significant.

In addition to the wasted silicon area, devices constructed using conventional silicon integrated circuit fabrication have limitations that are imposed by the design rules of the fabrication line and the limitations as to materials that are allowed on that line. For many applications, the dielectric insulation between the coils of the transformer must withstand voltages in excess of 1000 volts. The thickness of dielectric that is available in conventional CMOS fabrication lines is insufficient to provide this degree of insulation. In addition, in some applications it would be advantageous to provide a ferrite layer or layers near the coils of the transformer to improve the coupling efficiency. However, the materials in question cannot be utilized in many conventional fabrication lines.

In some cases, it would be advantageous to power one of the circuits from the other circuit. For example, the transmitting circuit could power the receiving circuit. Such an arrangement would allow the receiving circuit to operate at different voltages than the transmitting circuit without requiring a separate power source on the receiving circuit. In principle, a transformer could also be utilized to provide the power transfer function. However, the efficiency required to provide the power transfer function is significantly greater than that needed to merely transmit information. Hence, such transformers are not easily, or economically, constructed using silicon-based fabrication techniques.

Miniature transformers constructed by winding wire around small cores are also known to the art. However, these devices are made one at a time, and hence, lack the economies of scale that are provided by wafer-scale photolithographic techniques and other mass production techniques developed for integrated circuits and the packaging thereof. Miniature transformers made by plating the coil pattern for the primary coil winding on one side of a printed circuit board and the secondary winding on the other side of the printed circuit board are also known. However, these dielectric core transformers have insufficient windings and are required to operate at relatively high frequencies because of the lack of a soft ferrite core.

SUMMARY OF THE INVENTION

The present invention includes a component coil for constructing transformers and the transformer constructed therefrom. A component coil according to the present invention includes a substrate having an insulating layer of material having top and bottom surfaces. The top surface includes a first trace having an outer end and an inner end and a first spiral conductor connected between the outer and inner ends of the first trace. The bottom surface includes a second trace having an outer end and an inner end and a second spiral conductor connected between the outer and inner ends of the second trace. A conductor connects the inner ends of the first and second traces. The outer ends of the first and second traces are connected to first and second contacts, respectively. The first and second spiral conductors are oriented such that a current traveling from the outer end of the first trace to the inner end of the first trace generates a magnetic field having a first component perpendicular to the top surface, and a current passing from the inner end of the second trace to the outer end of the second trace generates a magnetic field having a second component perpendicular to the top surface. The first component has a direction that is the same as the second component.

A transformer according to the present invention includes a primary winding and a secondary winding in which one of the windings is a first component coil. An insulator separates the primary and secondary windings. The first component coil is aligned with the other of the primary and secondary windings such that a portion of the magnetic field generated by the first component coil passes through the other winding when a potential difference is applied between power pads of the first component coil. In one aspect of the invention, the other of the primary and secondary windings includes a second component coil and the primary or secondary winding includes a third component coil aligned with the first component coil such that a portion of the magnetic field generated by the third component coil passes through the first trace in the second component coil when a potential difference is applied between the power pads of the first component coil, or second component coil, respectively. In another aspect of the invention, the first component coil includes a layer of magnetically-active material.

DETAILED DESCRIPTION OF THE PREFERRED EMBODIMENTS OF THE INVENTION

A transformer according to the present invention is constructed by combining a number of component coils to form the primary and secondary windings of the transformer. Each component coil is constructed on an insulating substrate and includes first and second traces that can be generated using conventional photolithographic techniques of the type utilized in making printed circuit boards or semiconductor devices.

Figure 1:
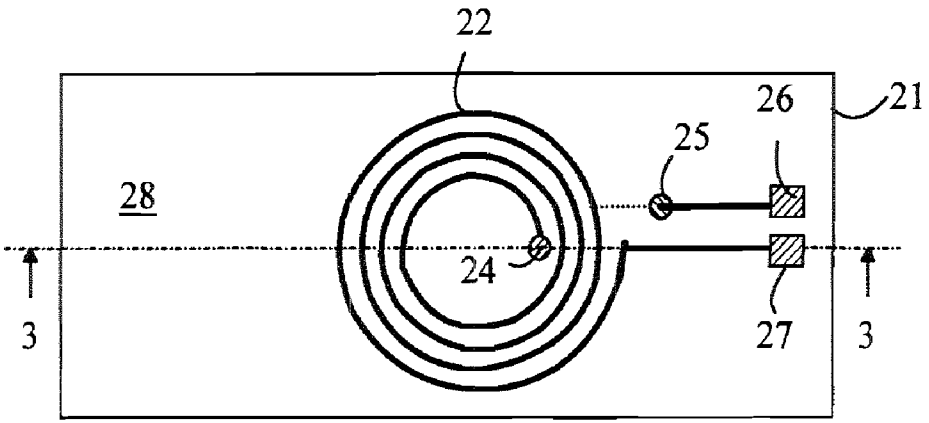
FIG. 1 is a top view of component coil 20.
Figure 2:
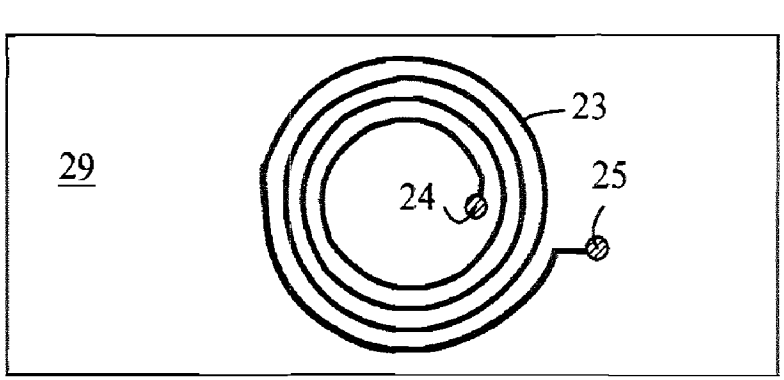
FIG. 2 is a bottom view of component coil 20.
Figure 3:
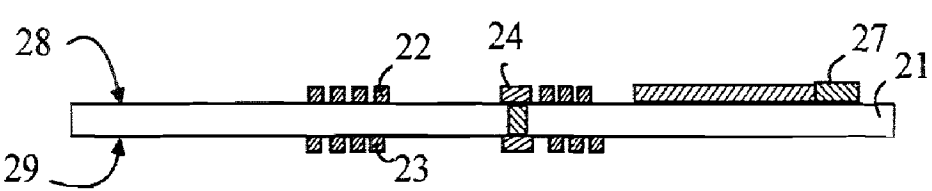
FIG. 3 is a cross-sectional view of component coil 20 through line 3-3 shown in FIG. 1.

The manner in which the present invention provides its advantages can be more easily understood with reference to FIGS. 1-3, which illustrate a component coil according to one embodiment of the present invention. FIG. 1 is a top view of component coil 20; FIG. 2 is a bottom view of component coil 20, and FIG. 3 is a cross-sectional view of component coil 20 through line 3-3 shown in FIG. 1. Component coil 20 has a first trace 22 that is deposited on the top surface 28 of an insulating substrate 21, and a second trace 23 that is deposited on the bottom surface 29 of substrate 21. The first and second traces are connected by a vertical conductor 24 that extends through substrate 21. Conductor 24 could be constructed by filling a via through substrate 21 with an electrically conducting material. The end of trace 23 that is not connected to trace 22 is routed to the top surface of substrate 21 with the aid of the vertical conductor shown at 25. Hence, the two traces form an electrically continuous conductor through which a current flows when a potential difference is applied between pads 26 and 27.

The portions of the traces that are designed to generate the magnetic fields that couple the various windings in transformers constructed from the component coils are topologically spirals. While the drawings show generally circular spirals, any linear pattern that winds in a continuous and gradually widening curve around a central region can be utilized. The spirals are configured such that a current flowing through one of the spirals generates a magnetic field with a component that is perpendicular to the surface of substrate 21 in the central region. The direction of the current flow through the two spirals is such that these magnetic field components add.

The traces can be patterned on a wide variety of substrates. Substrates that are used in conventional printed circuit boards or flexible carriers are particularly attractive, as there is a well-developed technology for fabricating multiple layers of metal traces with selective connections between the traces on various layers. Printed circuit boards or circuit carriers are known to the art, and hence, will not be discussed in detail here. For the purposes of the present discussion it is sufficient to note that printed circuit boards can be fabricated by depositing thin metal layers, or attaching metal layers, on a somewhat flexible organic/inorganic substrate formed of fiberglass impregnated with epoxy resin and then converting the layers into a plurality of individual conductors by conventional photolithographic techniques.

Embodiments based on flex circuit technology are also attractive, as the substrates are inexpensive and can be provided with a thin substrate layer. The substrates are made of an organic material such as polyimide. Films and laminates of this type are available commercially from Dupont and utilize substrates called Kapton™ made from polyimide and, in some cases, a plurality of layers are provided with an adhesive. Embodiments in which other layers are provided by sputtering, or lamination are also available. In one embodiment, a Pyralux AP laminate from Dupont that has a 2 mils thick Kapton™ layer and copper layers on the top and bottom surfaces are utilized. In contrast to conventional printed circuit boards, flex carriers are flexible and can be bent to conform to various patterns.

Substrates made of other plastics or polymers can also be utilized depending on the particular application. In addition, inorganic substrates such as glass or ceramics could be utilized. The particular choice of substrate will, in general, depend on cost and the particular application. For example, glass and ceramic substrates are well suited for applications involving high voltages.

To simplify the following discussion, a component coil will be defined to be a substrate having a substantially planar insulating layer of material having top and bottom surfaces. The top surface includes a first trace having an outer end and an inner end and a first spiral conductor connected between said outer and inner ends of the first trace. As noted above, the spiral conductor includes a continuous and gradually widening linear conductor that forms a curve around a central region. The bottom surface includes a second trace having an outer end and an inner end and a second spiral conductor connected between said outer and inner ends of the second trace. A conductor connects the inner ends of the first and second traces. The central regions of the first and second spiral conductors overlie one another. The first and second spiral conductors are oriented such that a current traveling from the outer end of the first trace to the inner end of the first trace generates a magnetic field having a first component perpendicular to the top surface in the central region of that trace, and a current passing from the inner end of the second trace to the outer end of the second trace generates a magnetic field having a second component perpendicular to the top surface in the central region of the second trace, the first component having a direction that is the same as that of the second component. The outer ends of the first and second traces are accessed by power pads or wire bond pads that are part of the component coil.

Figure 4:
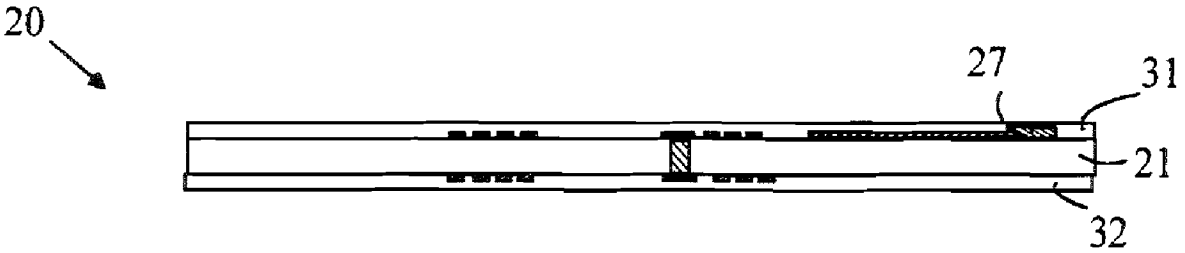
FIG. 4 is a cross-sectional view of component coil 20 after insulating layers have been applied to the top and bottom surfaces.

Two or more of the component coils can be combined to provide a coil having additional windings. The component coils are combined by bonding the coils to one another and connecting the leads from the various component coils in the desired manner. Refer now to FIG. 4, which is a cross-sectional view of component coil 20 after insulating layers have been applied to the top and bottom surfaces. The insulating layers are shown at 31 and 32. The insulating layers protect the traces from environmental damage and also prevent the traces from being shorted by contact with a conductor that is external to the component coil or when the component coils are stacked as discussed below.

The insulating layers will, in general, depend on the substrate used to construct the component coil. For example, in the case of a flexible carrier made from Kapton, the insulating layers can be provided by bonding a thin Kapton layer to the top and bottom surfaces using an insulating adhesive. If substrate 21 were constructed from glass or a ceramic, the insulating layers could be constructed by depositing a glass or ceramic layer over each surface of the substrate or Kapton could be used.

Figure 6:
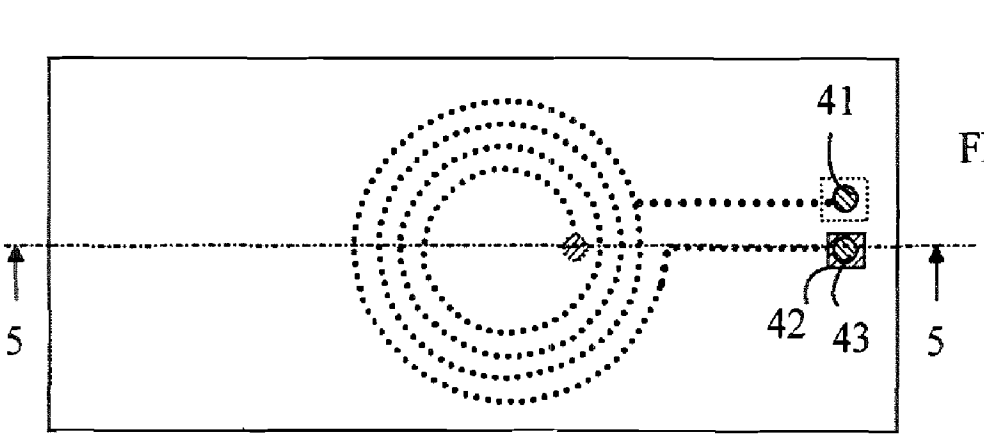
FIG. 6 is a top view of compound component coil 40.
Figure 5:
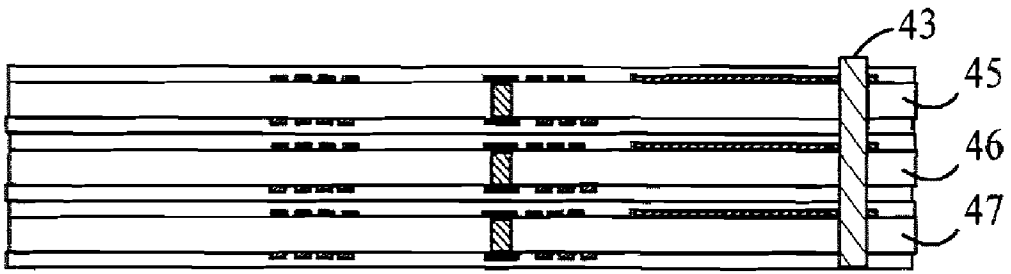
FIG. 5 is a cross-sectional view of compound component coil 40 through line 5-5 shown in FIG. 6.

As noted above, two or more component coils can be connected together to provide a component coil having additional windings. Refer now to FIGS. 5-6, which illustrate a compound component coil that includes 3 component coils that are bonded together. FIG. 6 is a top view of compound component coil 40, and FIG. 5 is a cross-sectional view of compound component coil 40 through line 5-5 shown in FIG. 6. The individual component coils that make up compound component coil 40 are shown at 45-47. When the component coils are intended for stacking as shown in FIGS. 5-6, the bottom trace can terminate in a pad on the bottom surface of the component coil rather than being extended to the top surface through a via such as via 25 shown in FIG. 1. After the component coils have been bonded together, the stack of component coils can be connected electrically by drilling holes through the connection pads on which the individual traces terminate and then filling the hole with a conductor to provide vertical interconnects as shown at 41 and 43. Each vertical interconnect passes through a connection pad such as pad 42 that is connected to one of the traces in the component coil. In the arrangement shown in FIGS. 5-6, the coils are connected in parallel rather than in series. That is, the top traces on each component coil are connected to vertical interconnect 43, and the bottom traces on each component coil are connected to vertical interconnect 41. The parallel connection provides a lower resistance path than a series connection in which the bottom trace on one component coil is connected to the top trace on the component coil below it in the stack of component coils.

While compound coils having traces connected in parallel have lower resistance, the need to drill and fill the vertical interconnects can pose problems, as the filling becomes more difficult as the hole aspect ratio (depth/diameter) increases. Hence, in some applications, it may be advantageous to use component coils that are connected in series.

Figure 7:
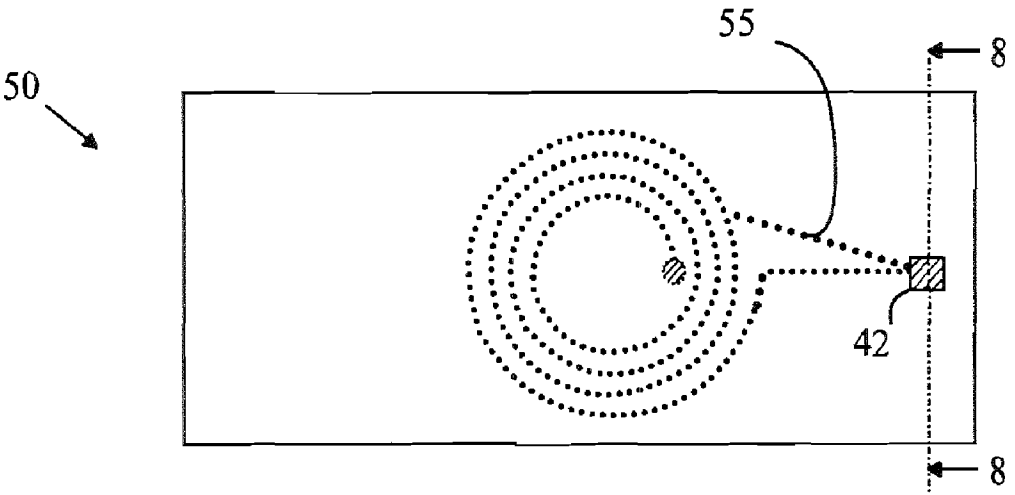
FIG. 7 is a top view of component coil 50.
Figure 8:
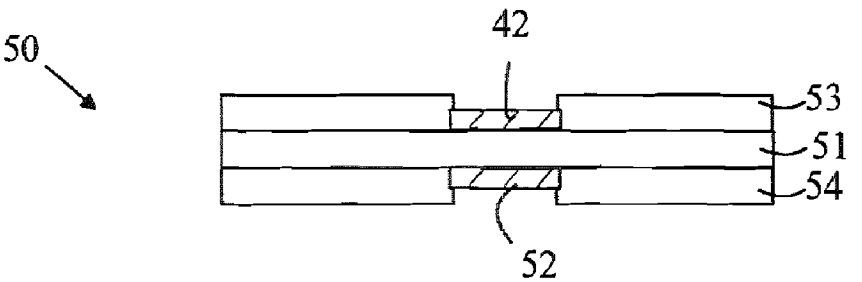
FIG. 8 is a cross-sectional view of component coil 50 through line 8-8 shown in FIG. 7.

Refer now to FIGS. 7 and 8, which illustrate another embodiment of a component coil according to the present invention. FIG. 7 is a top view of component coil 50, and FIG. 8 is a cross-sectional view of component coil 50 through line 8-8 shown in FIG. 7. Component coil 50 differs from component coil 20 shown in FIG. 1 in that the bottom trace 23 is extended on the bottom side of substrate 51 as shown at 55 and terminates in a pad 52 that is directly below pad 42 that connects to the trace on the top surface of substrate 51. The insulating layers shown at 53 and 54 have windows that allow access to pads 42 and 52. The windows can be provided by cutting the material from which the insulating layers are fabricated before the insulating layers are placed over substrate 51 or by removing the insulating material selectively after the insulating material has been bonded to or spun on substrate 51. For example, the windows could be provided by cutting the insulating layer in the case of a flexible substrate embodiment such as discussed above or by etching the top and bottom insulating layers in the case of a rigid embodiment such as the glass or ceramic layers discussed above.

Figure 9:
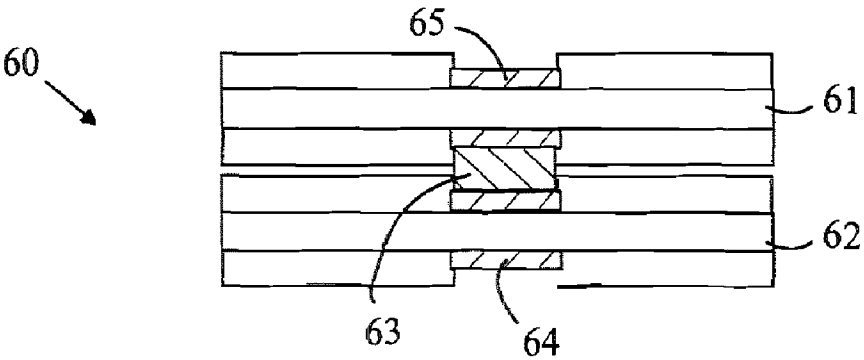
FIG. 9 is a cross-sectional view of two component coils of the type shown in FIGS. 7 and 8 after the two have been bonded to form a compound coil in which the component coils are connected in series.

Refer now to FIG. 9, which is a cross-sectional view of two component coils of the type shown in FIGS. 7 and 8 after the two have been bonded to form a compound coil 60 in which the component coils are connected in series. The two component coils shown at 61 and 62 are bonded together and connected electrically by applying a conductive bonding agent 63 between the top pad of component coil 62 and the bottom pad of component coil 61. The conductive bonding agent could be applied as solder balls or Au—Sn layers on the surface of the pads or any organic conductive bonding agent such as a conductive epoxy. The compound coil is powered by applying a potential between pads 64 and 65.

Figure 10:
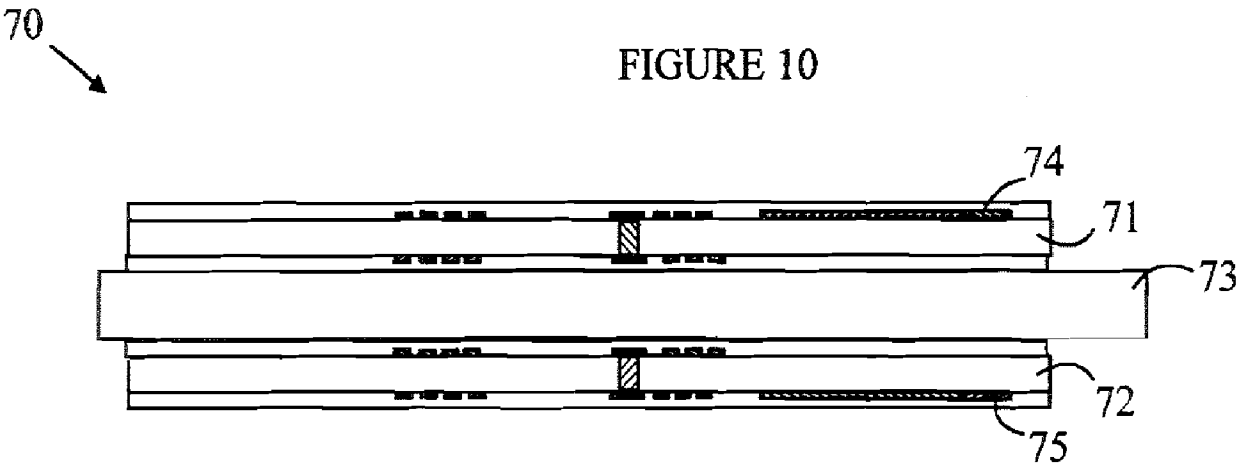
FIG. 10 is a cross-sectional view of one embodiment of a transformer according to the present invention.

The component coils can be combined to provide a transformer that has a primary and secondary winding. Refer now to FIG. 10, which is a cross-sectional view of one embodiment of a transformer according to the present invention. Transformer 70 is constructed from two component coils 71 and 72 that are bonded to an optional insulator 73. Component coils 71 and 72 have the same configuration as component coil 20 shown in FIG. 4. The primary winding is provided by component coil 71, and the secondary winding is provided by component coil 72. If the insulating properties of the insulating layer on the bottom and top surfaces of the component coils are insufficient to withstand the voltage differences between the primary and secondary windings, a separate insulating layer 73 could be provided between the component coils. The component coils are either bonded to one another or to insulating layer 73. Primary coil 71 is powered by the pads on the top surface of that component coil. One of the pads is shown at 74; however, it is to be understood that the top surface of component coil 71 includes a second pad that provides access to the trace on the bottom surface of the substrate from which component coil 71 is constructed. Similarly, the secondary coil is powered from pads on the top surface of component coil 72 such as pad 75. It should be noted that component coil 72 is mounted upside down to provide more convenient access to the pads on the top surface of component coil 72.

Figure 11:
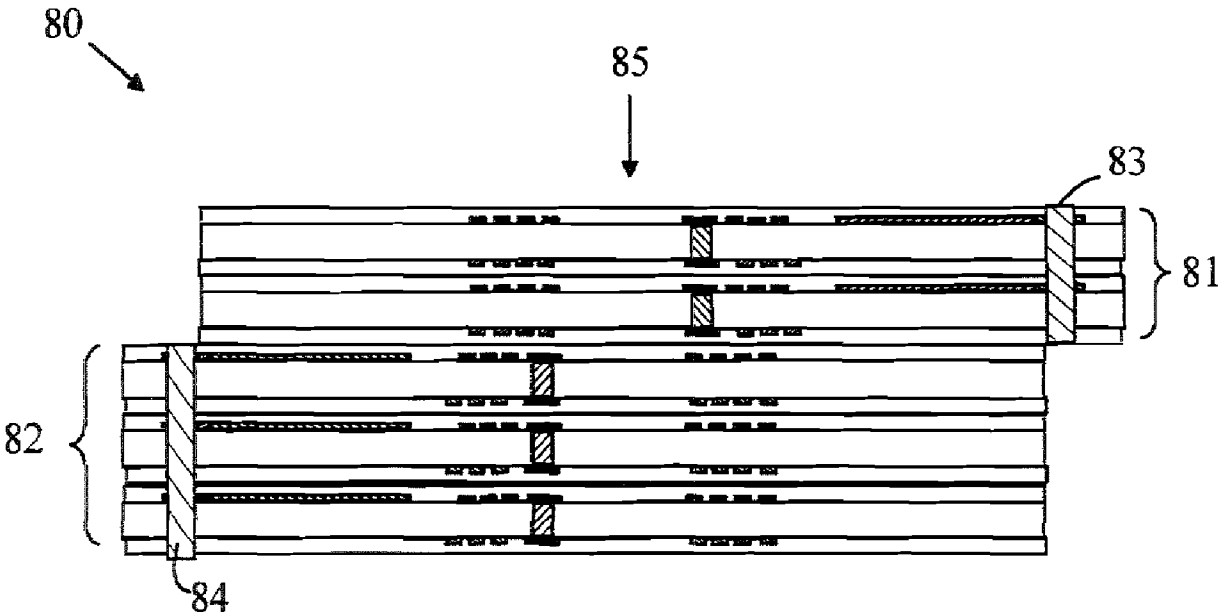
FIG. 11 is a cross-sectional view of another embodiment of a transformer according to the present invention.

Embodiments in which the primary and/or secondary windings are constructed from a plurality of component coils can also be constructed. In this case, component coil 71 and/or component coil 72 shown in FIG. 10 would be replaced by a compound coil such as the compound coils discussed above. Refer now to FIG. 11, which is a cross-sectional view of another embodiment of a transformer according to the present invention. Transformer 80 includes a primary winding 81 constructed from a compound coil having two component coils connected in parallel and accessed from vertical conductors of which conductor 83 is an example. The secondary winding shown at 82 is constructed from a compound coil having 3 component coils that are also connected in parallel and accessed by vertical conductors such as conductor 84. In this embodiment, the insulating layer over traces in the component coils is sufficient to prevent arcing between the coils, and hence, an additional insulating layer between the primary and secondary coils is not needed. The various component coils in transformer 80 are aligned such that the central regions of each of the component coils are aligned with one another as shown at 85.

Figure 12:
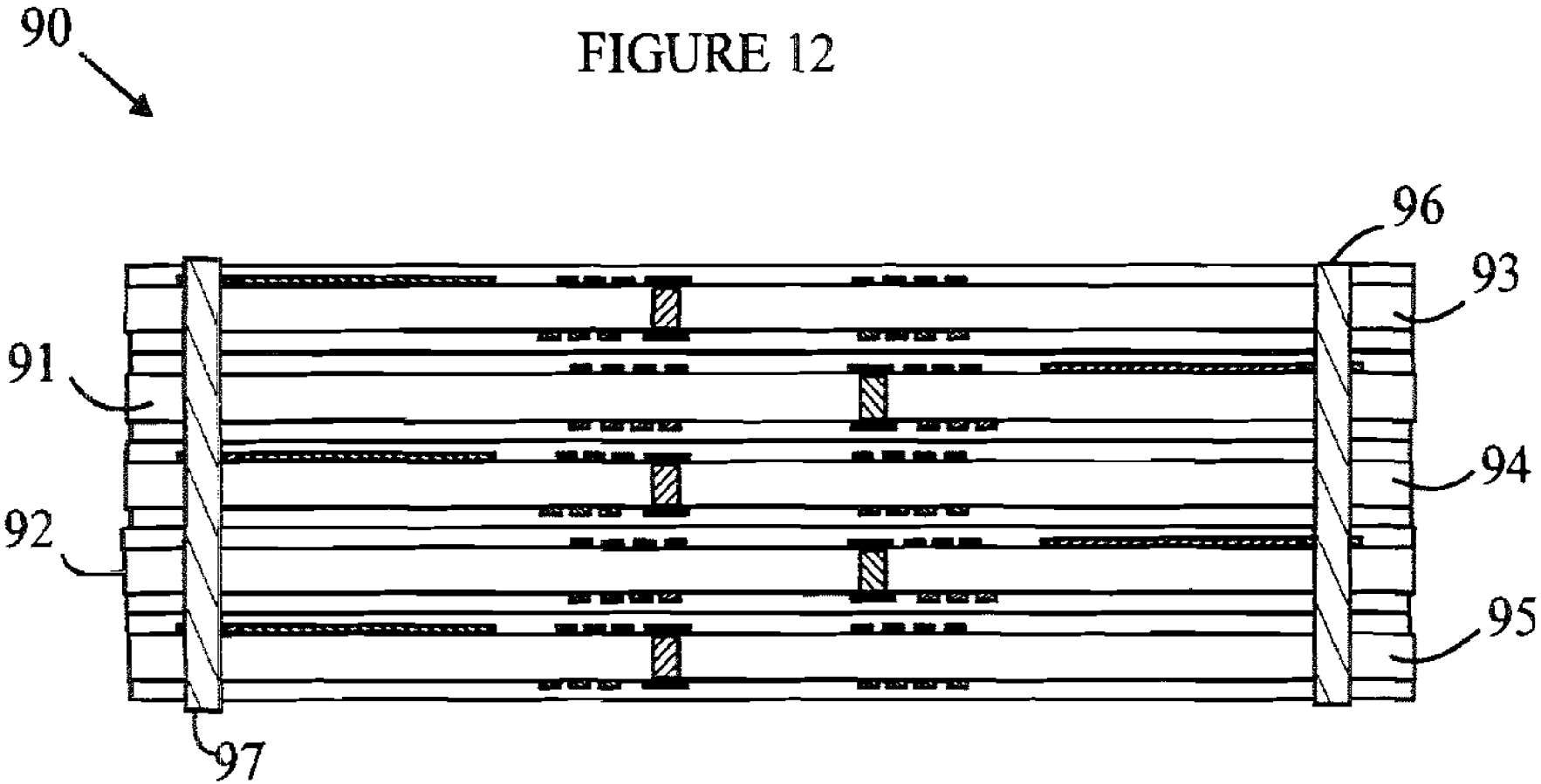
FIG. 12 is a cross-sectional view of another embodiment of a transformer according to the present invention.

In the above-described transformer embodiments, the component coils that made up the primary winding of the transformer were separated from those that made up the secondary winding of the transformer. However, embodiments in which the component coils that make up the primary and secondary windings are intermingled could also be constructed. Refer now to FIG. 12, which is a cross-sectional view of another embodiment of a transformer according to the present invention. The primary winding of transformer 90 includes component coils 91 and 92 that are accessed by a first pair of vertical conductors of which conductor 97 is an example. The secondary winding includes component coils 93-95 that are accessed by a second pair of vertical conductors of which conductor 96 is an example. By intermixing the component coils of the two windings, the magnetic field generated in the component coils of the primary winding is more efficiently transferred to the component coils of the secondary winding.

Figure 13:
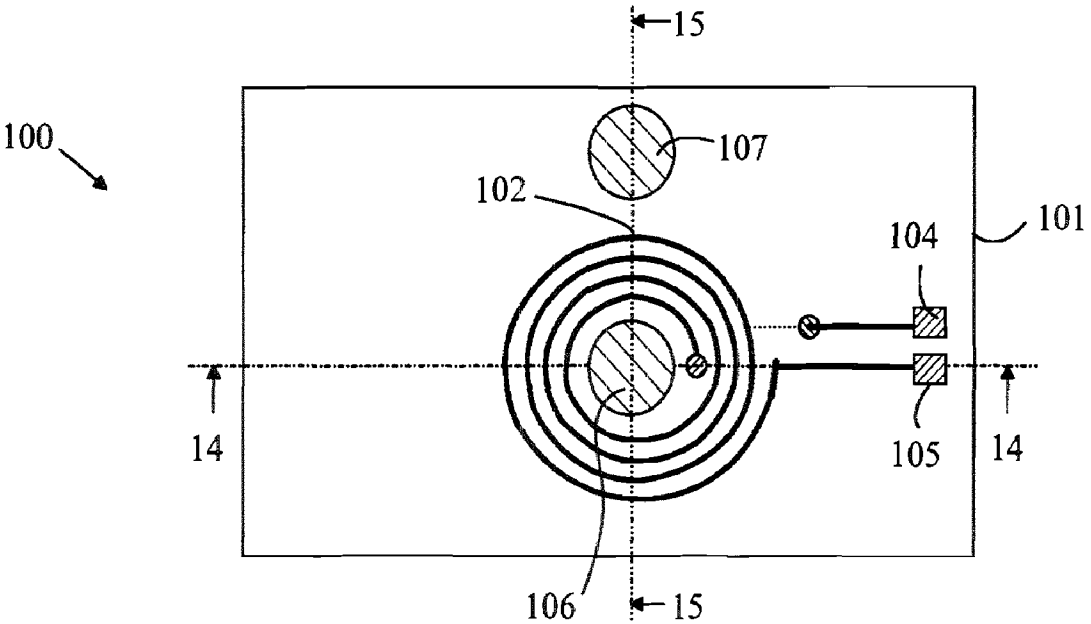
FIG. 13 is a top view of component coil 100 with the top insulation layer removed.
Figure 14:
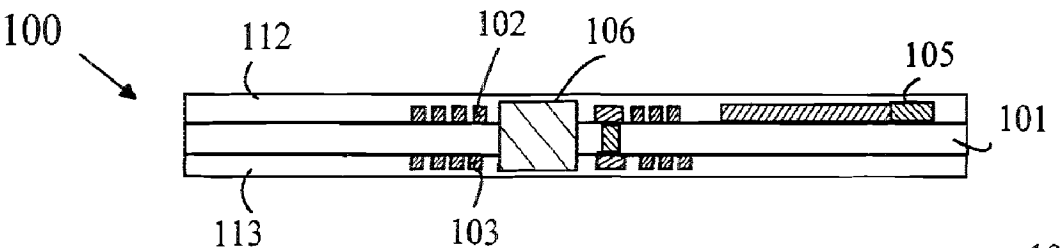
FIG. 14 is a cross-sectional view through line 14-14 shown in FIG. 13 with an insulation layer in place.
Figure 15:
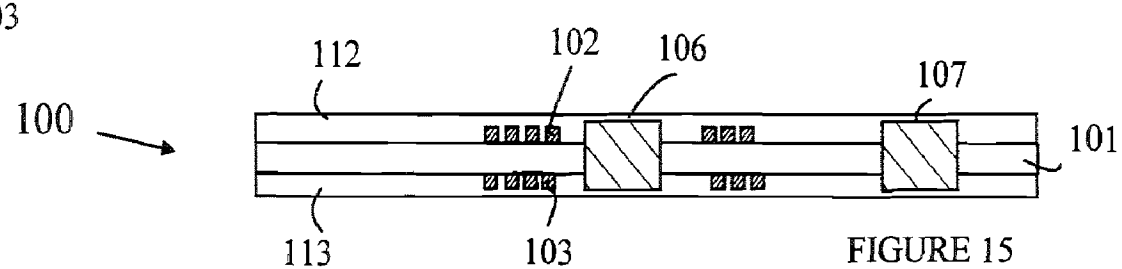
FIG. 15 is a cross-sectional view through line 15-15 shown in FIG. 13.

The embodiments described above are analogous to air or dielectric core transformers. However, embodiments that incorporate magnetically-active materials such as ferrite, and in particular soft ferrite, can also be constructed. Refer now to FIGS. 13-15, which illustrate another embodiment of a component coil according to the present invention. FIG. 13 is a top view of component coil 100 with the top insulation layer removed. FIG. 14 is a cross-sectional view through line 14-14 with insulation layer 112 in place. FIG. 15 is a cross-sectional view through line 15-15 shown in FIG. 13. Component coil 100 is similar to component coil 20 discussed above in that component coil 100 includes a top trace 102 and a bottom trace 103 that are deposited on a substrate 101 and that are configured to form a coil that is accessed from pads 104 and 105. The top and bottom traces are protected by insulating layers 112 and 113. However, component coil 100 also includes ferrite regions 106 and 107 that extend through substrate 101. These regions can be constructed by removing the appropriate areas in substrate 101 and filling the resultant hole with the ferrite material. When the component coils are stacked, these ferrite regions can be connected by two additional ferrite layers on the top and bottom surfaces of the transformer to form a flux loop to improve the transfer of power between the primary and secondary windings of the transformer.

Figure 16:
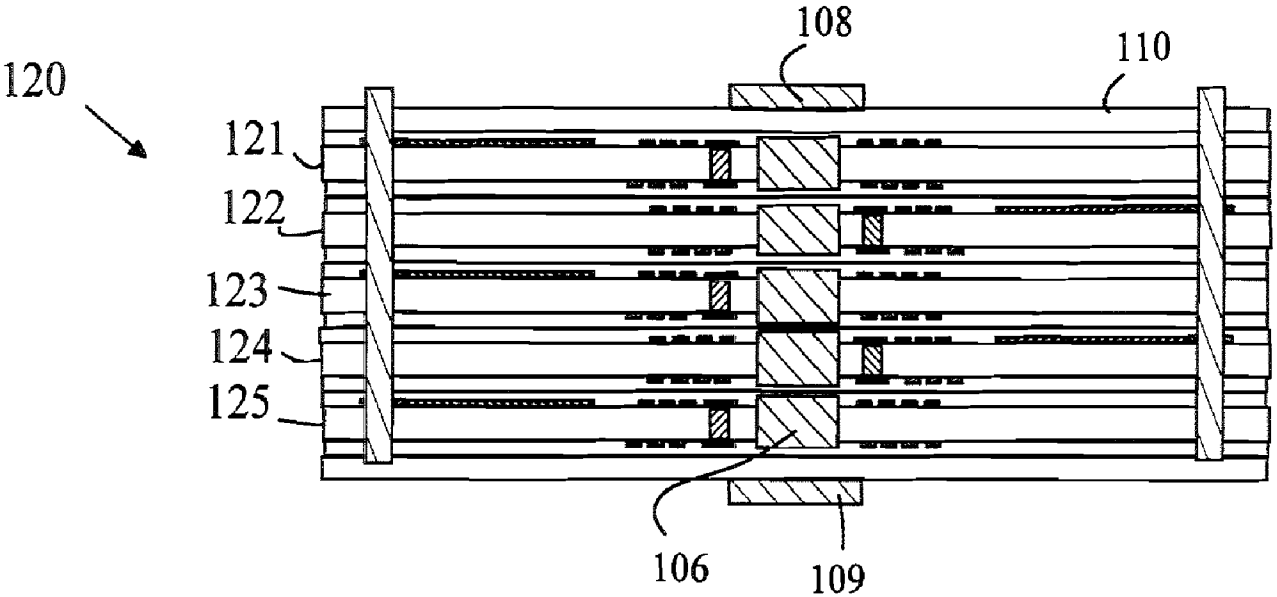
FIG. 16 is a cross-sectional view of a transformer 120 constructed from a stack of component coils 100 through a plane passing through line 14-14 shown in FIG. 13.
Figure 17:
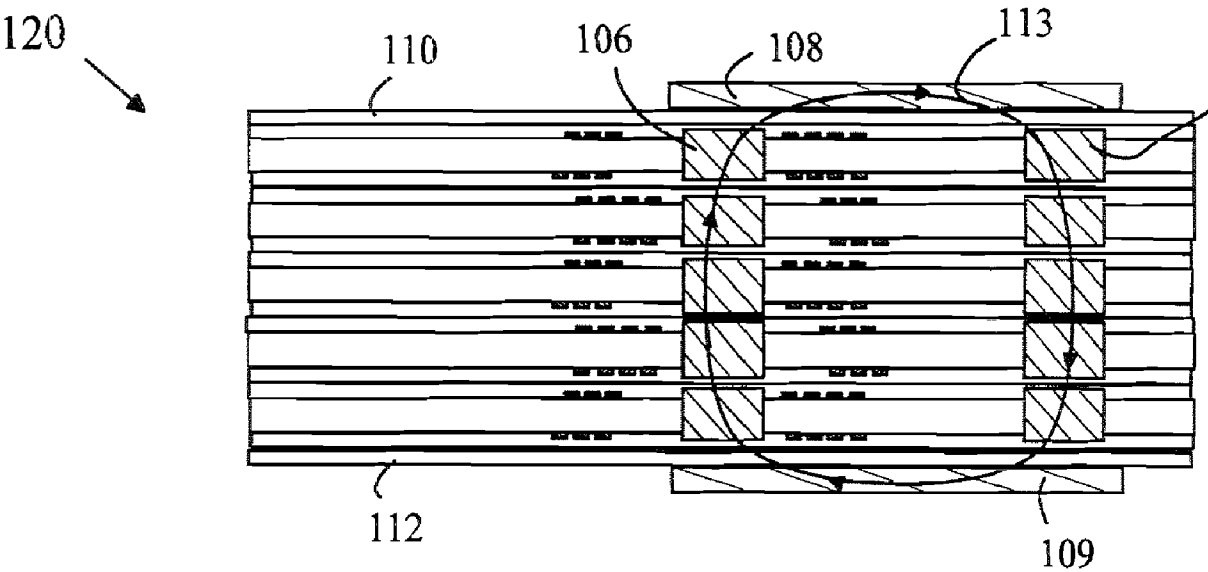
FIG. 17 is a cross-sectional view of transformer 120 through a plane passing through line 15-15 shown in FIG. 13.

Refer now to FIGS. 16 and 17, which illustrate another embodiment of a transformer according to the present invention. Transformer 120 is constructed by stacking a number of component coils in a manner analogous to that described above with reference to FIG. 12. FIG. 16 is a cross-sectional view of transformer 120 through a plane passing through line 14-14 shown in FIG. 13, and FIG. 17 is a cross-sectional view through a plane passing through line 15-15 shown in FIG. 13. Transformer 120 is constructed from component coils 121-125. The primary winding includes component coils 121, 123, and 125, and the secondary winding includes component coils 122 and 124. After the component coils have been bonded together and connected by the vertical conductors, two flux return segments 108 and 109 are added at each end of the stack of component coils. The flux return segments can be part of separate layers such as layers 110 and 112 that are applied to the stack after the component coils have been combined. The flux return segments complete a flux loop 113.

It should be noted that in embodiments in which space is a limiting factor, ferrite region 107 and the flux return layers 108 and 109 could be omitted. While the efficiency of energy transfer between the primary and secondary windings will be less efficient, such embodiments would still be better than embodiments that just utilize a non-ferrite core.

Figure 18:
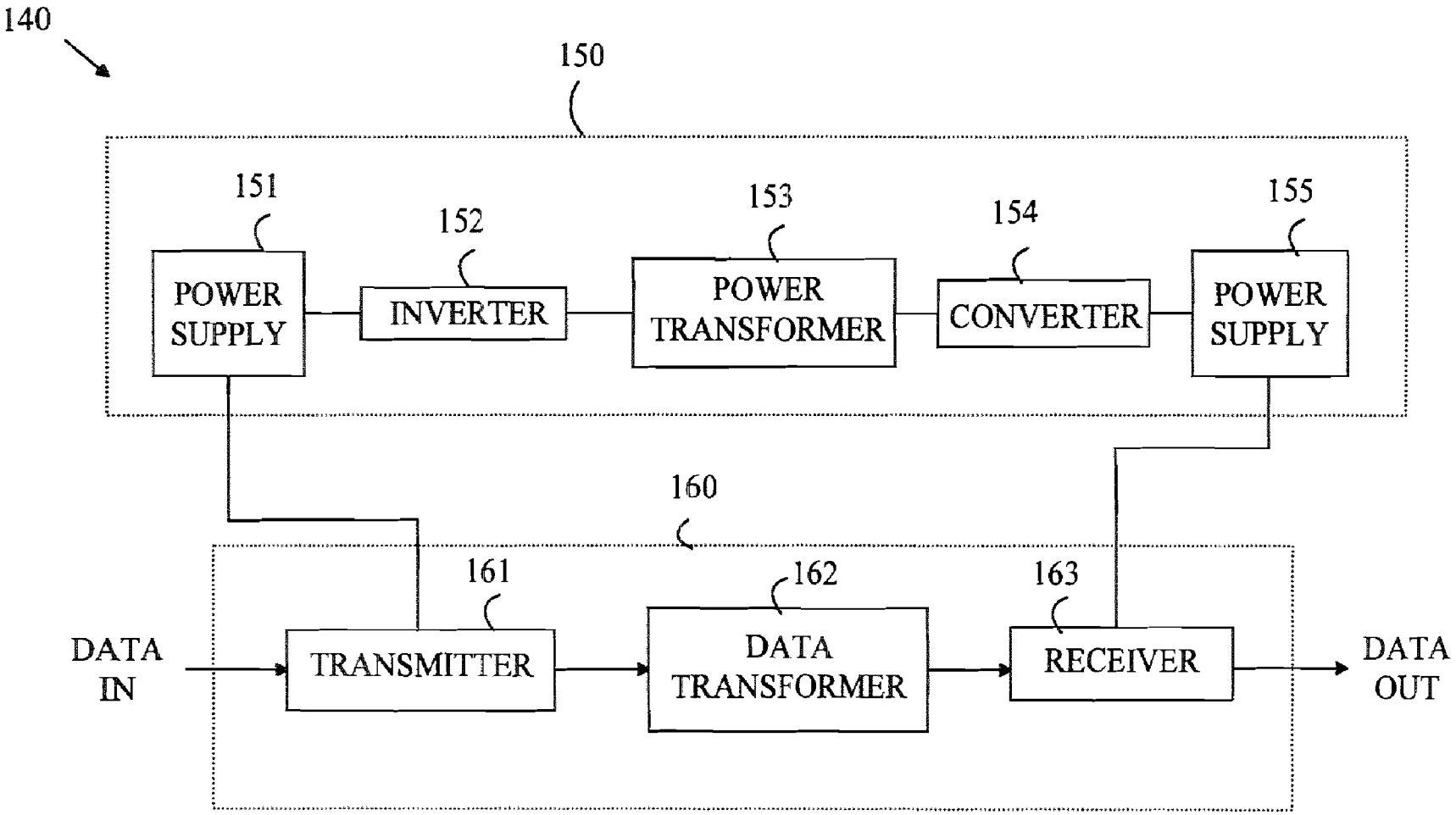
FIG. 18 illustrates a galvanic isolator according to one embodiment of the present invention.

Transformers according to the present invention could be utilized to construct a galvanic isolator in which the components on one side of the isolation barrier are powered by a power source on the other side of the isolation barrier. Refer now to FIG. 18, which illustrates a galvanic isolator according to one embodiment of the present invention. Galvanic isolator 140 includes a power section 150 and a data transfer section 160. Data transfer section 160 includes an isolation gap that blocks transients and/or performs voltage shifts between the circuitry on the transmitter side of the gap and the circuitry on the receiver side of the isolation gap. Galvanic isolator 140 utilizes two transformers. Transformer 62 provides the isolation barrier for transfer data from transmitter 161 to receiver 163. Transformer 153 is used to transfer power from a power supply 151 on the transmitter side of the isolation gap to provide a power supply 155 on the receiver side of the isolation gap. Both of these transformers could be transformers according to the present invention.

Power section 150 includes a power supply 151 that powers the circuitry on both sides of the isolation gap. An inverter 152 generates an AC power signal from the DC power provided by power supply 151. The AC power signal is transferred to the receiver side of the isolation gap by a power transformer 153 according to the present invention. The secondary winding of power transformer 153 is rectified by converter 154 to provide a power supply 155 that is used to power receiver 163. It should be noted that the DC potentials provided by power supplies 151 and 155 could be the same or different, depending on the particular galvanic isolator design. Power transformer 153 can provide a voltage step up or step down to facilitate the generation of the different output voltages. It should also be noted that embodiments in which power is derived from a train of pulses applied to power transformer 153 from a source that is external to the galvanic isolator could also be constructed.

It should be noted that CMOS circuitry is not well adapted for rectifying AC power signals at high frequencies. Hence, converter 154 is preferably a separate component that is fabricated in a different integrated circuit system. However, if inverter 152 and transformer 153 are designed to operate at a frequency compatible with CMOS devices, the need for a separate component can be avoided. As pointed out above, the transformers of the present invention can be constructed using conventional circuit carriers or printed circuit boards. Hence, in one embodiment of the present invention, converter 154 is a separate circuit module that is located on the same circuit carrier as power transformer 153. Alternatively, the components of power section 150 and data transfer section 160 can be packaged in respective integrated circuit packages or together in a single larger integrated circuit package.

While galvanic isolator 140 utilizes a transformer for providing the data isolation gap, other forms of isolator could be utilized in combination with power section 150. The data isolation gap can be provided by a split circuit element in which one half of the element is on the transmitter side of the gap, and the other half is on the receiver side of the gap. For example, isolators based on optical links in which the transmitter generates a light signal that is received by a photodetector are known to the art.

Figure 19:
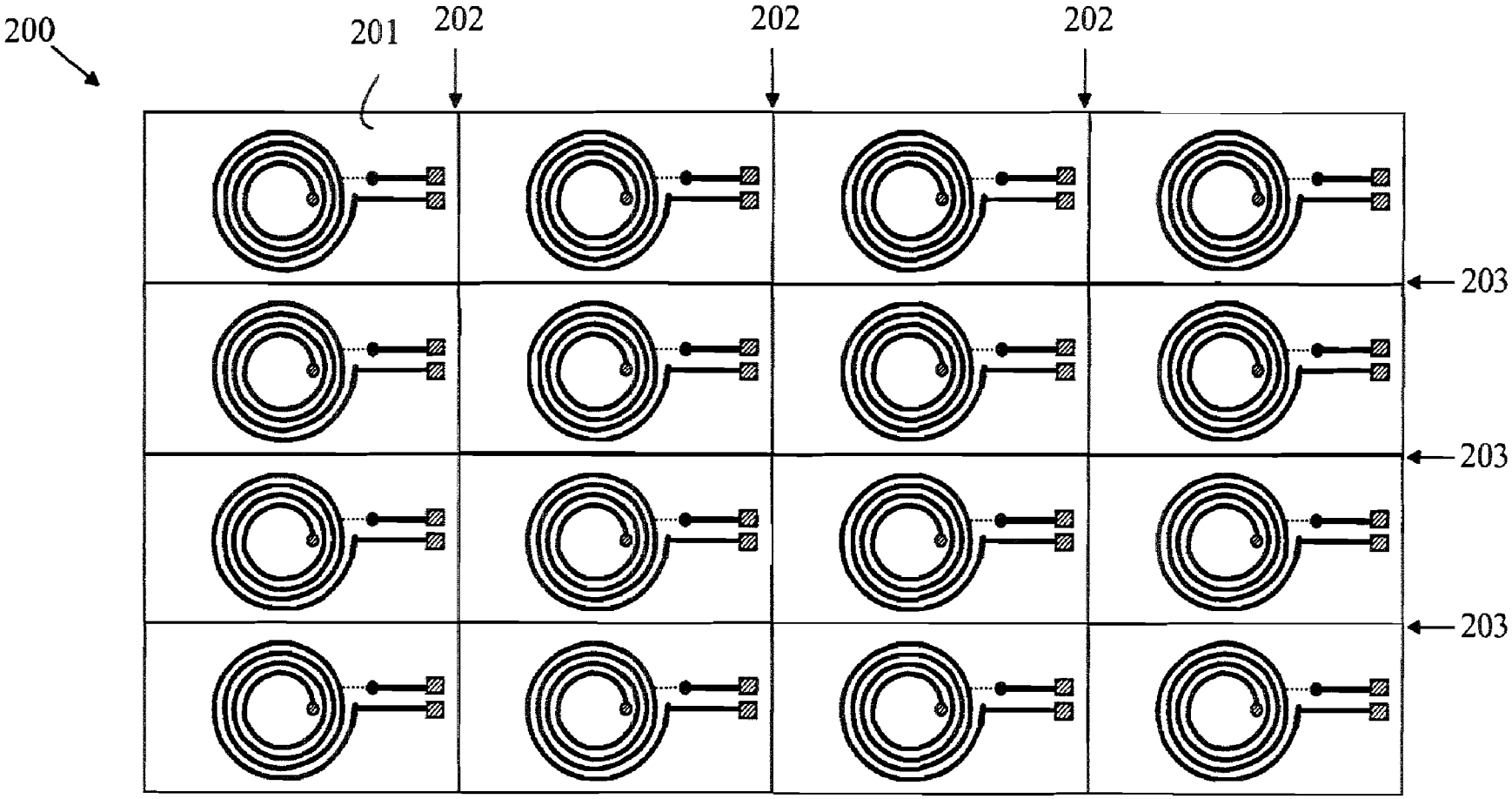
FIG. 19 is a top view of a sheet of component coils with the top insulating layer removed.

A transformer according to the present invention can be constructed by stacking and bonding sheets of component coils. Refer now to FIG. 19, which is a top view of a sheet of component coils with the top insulating layer removed. Sheet 200 can be constructed on a large printed circuit board substrate or large flexible circuit carrier. A typical component coil is shown at 201. A plurality of such sheets are stacked and bonded to form a sheet of transformers in which each transformer has a cross-section similar to the transformers discussed above. If the transformers are to have a ferrite core with a flux return, a top and bottom sheet is applied to the stack. The top and bottom sheets include the flux return segments discussed above. After all of the sheets have been bonded, the stack is cut along the lines shown at 202 and 203 to provide the individual transformers. Hence, a transformer according to the present invention can take advantage of the large scale, low cost fabrication techniques developed for printed circuit board and carrier fabrication.

The above-described embodiments of the present invention could be modified to include traces and mounting pads for additional circuit elements. The transformers of the present invention already include structures analogous to conventional printed circuit board layers. Hence, providing attachment points for other circuit components is relatively inexpensive. As noted above, an attachment point for a power converter that rectifies the output of the secondary winding of the transformer is particularly useful. In addition, attachment pads for mounting other circuit components such as the receiver and transmitter die discussed above are also useful.

Figure 20:
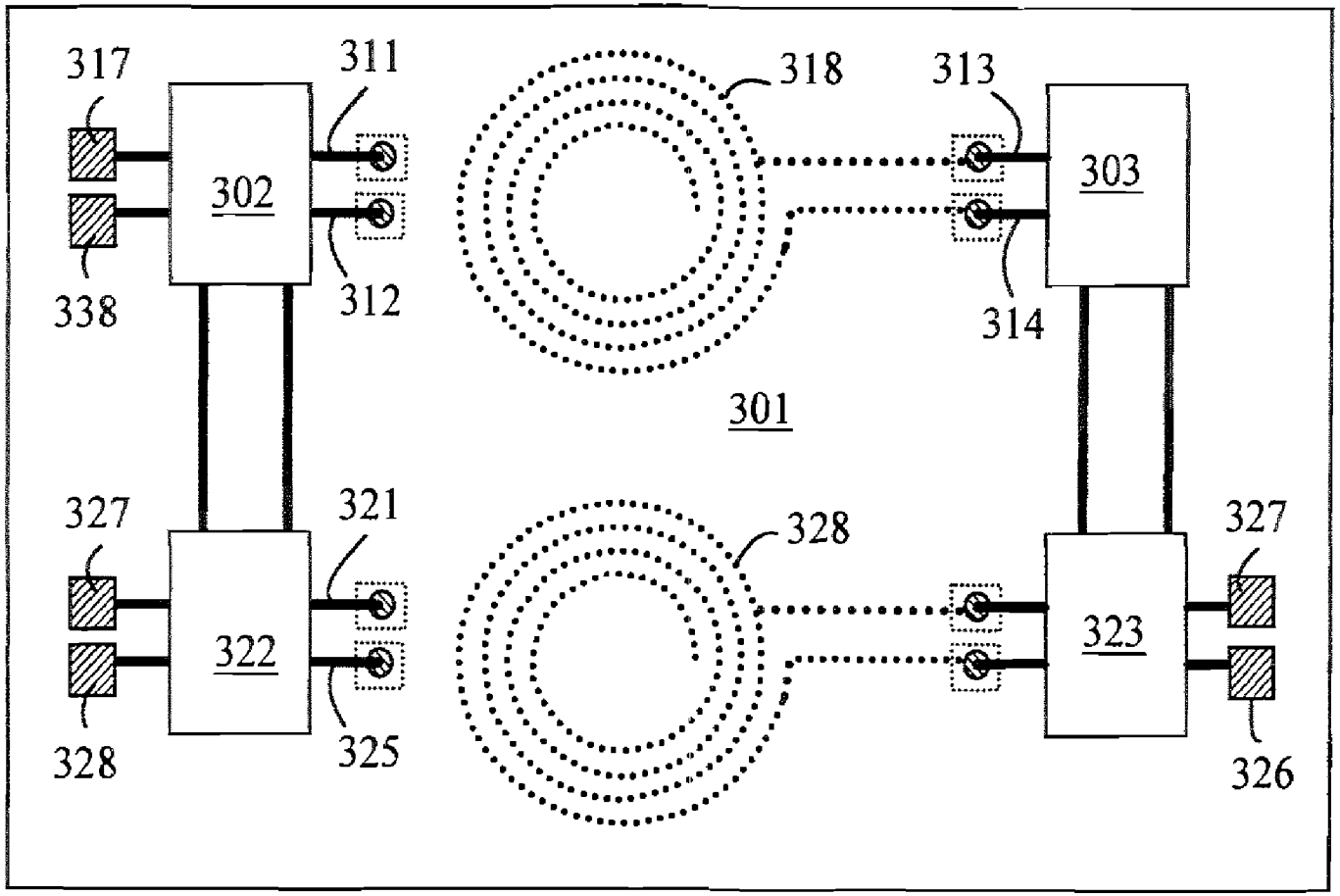
FIG. 20 illustrates one embodiment of a galvanic isolator according to the present invention.

Refer now to FIG. 20, which illustrates one embodiment of a galvanic isolator according to the present invention. Galvanic isolator 300 includes a power section that includes a power supply device 302 that includes an inverter for converting the DC power received on bond pads 317 and 338 to an AC signal that is applied to the primary winding of a transformer 318 according to the present invention. The primary winding is accessed via traces 311 and 312 that connect to vertical conductors similar to those discussed above. The secondary winding of transformer 318 is connected to a power converter that is included in device 303 via traces 313 and 314. It should be noted that components 302, 303, 322, and 323 could be constructed from conventional integrated circuits or a combination of such circuits mounted on some form of sub-mount carrier.

Data for transmission across the isolation gap provided by transformer 328 is input on bond pads 327 and 328 to a transmitter 322. Transmitter 322 is connected to the primary winding of transformer 328 by traces 321 and 325 in a manner analogous to that described above with respect to device 302. The secondary winding of transformer 328 is connected to receiver 323. The data from receiver 323 is coupled to a device external to galvanic isolator 300 via bond pads 327 and 326.

It should be noted that both transformer 318 and transformer 328 can be fabricated from the same stack of component coils 301. This further reduces the cost of galvanic isolator 300.

The above-described embodiments of the present invention utilize component coils for both the primary and secondary windings. However, embodiments in which one of the primary or secondary windings utilizes a coil or coils having only one spiral trace could also be constructed. In such embodiments the connection to the inner end of the spiral coil can be made either by a trace on another surface of the substrate or by a wire bond that is connected to the inner end of the spiral coil. Coils of this construction are discussed in detail in co-pending U.S. patent application Ser. No. 11/512,034 which is hereby incorporated by reference.

Figure 21:
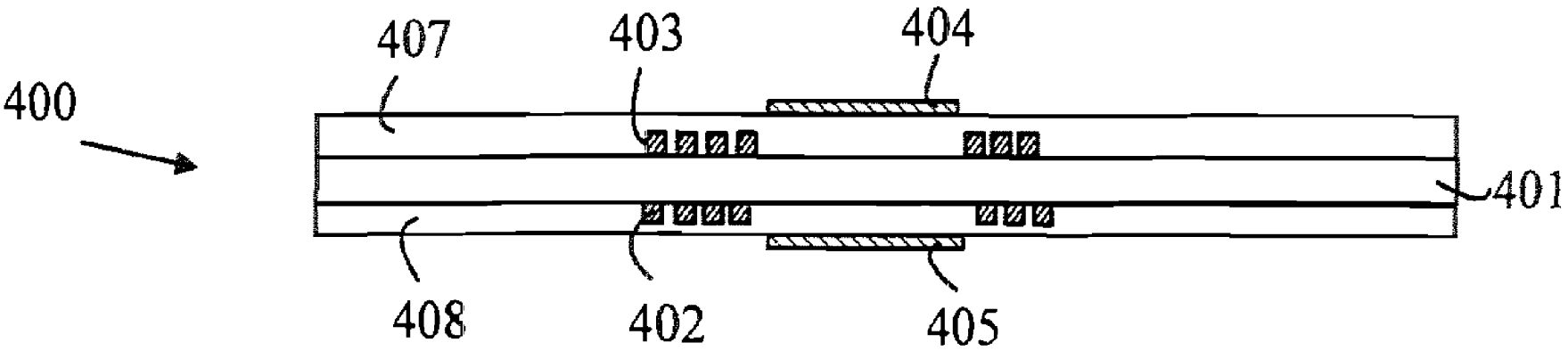
FIG. 21 is a cross-sectional view of another embodiment of a component coil according to the present invention.

Refer again to FIGS. 13 and 14. The component coils shown therein utilize a ferrite core 106 that is deposited in a hole in the coil. While this arrangement provides significantly improved magnetic coupling of the coils in a transformer, it is more difficult to fabricate than transformers that do not include this type of filled cavity. In addition, the return flux path through ferrite element 107 significantly increases the size of the transformer, which can be a problem in some applications. Hence, embodiments that have less efficient field coupling but lower construction costs and reduced size are useful in some applications. Refer now to FIG. 21, which is a cross-sectional view of another embodiment of a component coil according to the present invention. Component coil 400 is similar to the component coils described above in that the two coils shown at 402 and 403 are patterned from copper layers on the top and bottom surfaces of an insulating substrate 401. The coils are covered by thin insulating layers 407 and 408. Patterned ferrite layers 404 and 405 are formed on the exposed outer surfaces of the insulating layers. The patterned ferrite layers overlie the center region of the coils, but not the coils. When the component coils are stacked, the patterned ferrite layers are aligned with one another and provide an approximation to a continuous ferrite core that improves the coupling of the individual coils. In embodiments in which size is less critical, additional patterned layers that can be used to provide a return flux path in a manner analogous to that described above with reference to FIGS. 13 and 14 can also be included.

It should be noted that insulating layers 407 and 408 can be separately fabricated with the patterned ferrite layer thereon. Hence, the ferrite coupling feature can utilize the same basic component coil design and parts as non-ferrite component coils.

Figure 22:
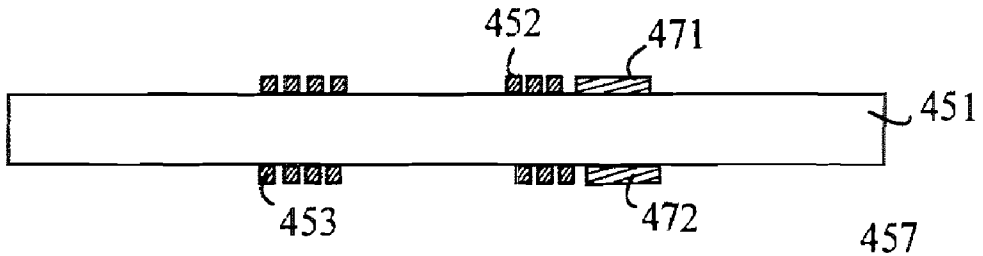
FIGS. 22-25 illustrate the fabrication of a transformer according to the present invention at various stages in the fabrication process.

The above-described embodiments of the present invention utilize prefabricated component coils. However, embodiments in which the component coils are fabricated from individual coils during the fabrication of a transformer can also be constructed. Refer now to FIGS. 22-25, which illustrate the fabrication of a transformer having one component coil in the primary winding and one component coil in the secondary winding. Referring to FIG. 22, the process starts with depositing a layer of a metal such as copper on each side of an insulating substrate 451. The layer is then patterned to form coils 452 and 453. The outer ends of coils 452 and 453 are connected to pads 471 and 472, respectively.

Figure 23:
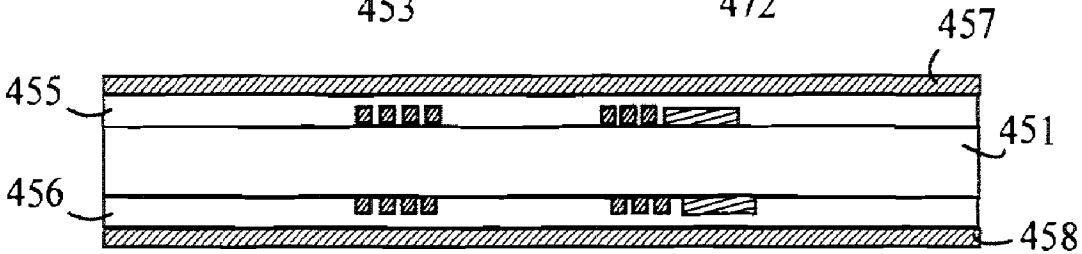
Figure 24:
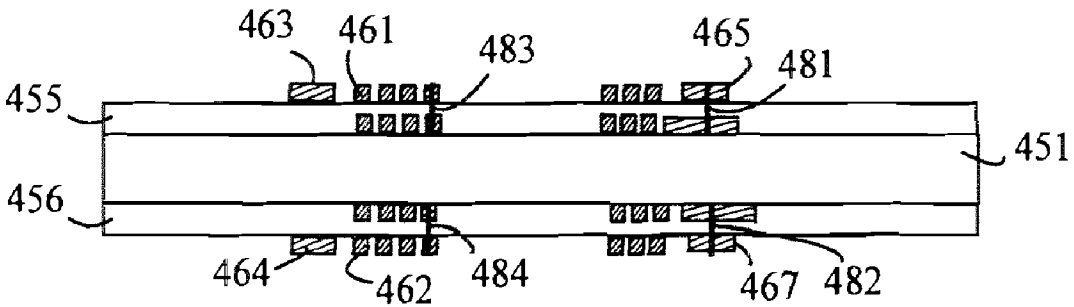

Next, layers of polyamide resin are placed over the coils as shown at 455 and 456 in FIG. 23. A metal layer is then deposited on the outer surface of each of these resin layers and patterned to form the two remaining coils as shown at 461 and 462 as shown in FIG. 24. The outer end of coil 461 is connected to a pad 463, and the outer end of coil 462 is connected to pad 464, which are also patterned from these metal layers. Pads 465 and 467, which overlie pads 471 and 472, respectively are also patterned from these metal layers. Pads 465 and 471 are then drilled and the holes filled to provide a vertical connection between the pads as shown at 481. Similar vertical connections are provided to connect the inner ends of coils 461 and 452 as shown at 483. The process is repeated for coils 462 and 453 to provide the vertical connects shown at 482 and 484.

Figure 25:
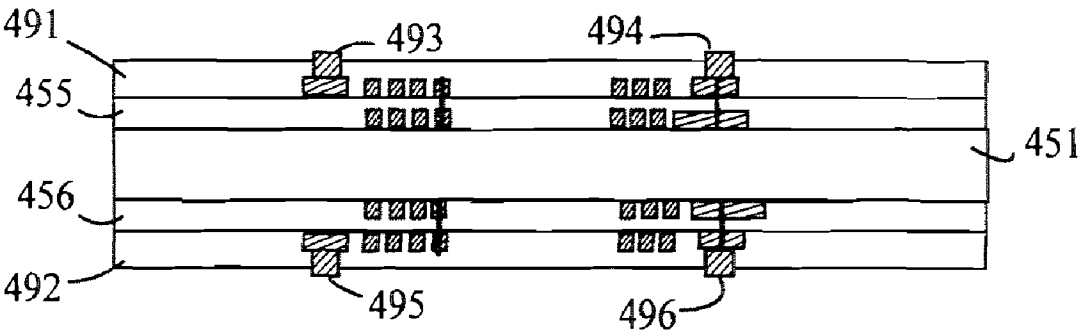

Next, insulating overlays that have predrilled holes to provide openings overlying pads 463, 465, 464, and 467 are bonded to each of the exposed surfaces as shown at 491 and 492 in FIG. 25. The holes are optionally plated with metal to provide wire bond pads 493-496.

As noted above, transformers according to the present invention are useful in constructing galvanic isolators that include two transformers, one for powering one of the receiver or transmitter and one for transmitting data. In some embodiments, the individual isolators may require shielding such that the magnetic field from one transformer is not coupled to the second transformer. For example, the power transformer, which generates a more intense magnetic field than the data transformer, could interfere with the data transmission if the alternating magnetic field generated in the power transformer is coupled to the data transformer. Such interference can be significantly reduced by providing a magnetic shielding layer on the top and bottom surfaces of the transformer.

In embodiments having a flux return loop such as the embodiments shown in FIGS. 16 and 17, shielding could be provided by extending layers 108 and 109 such that these layers cover the top and bottom surfaces, respectively, of the transformer.

Figure 26:
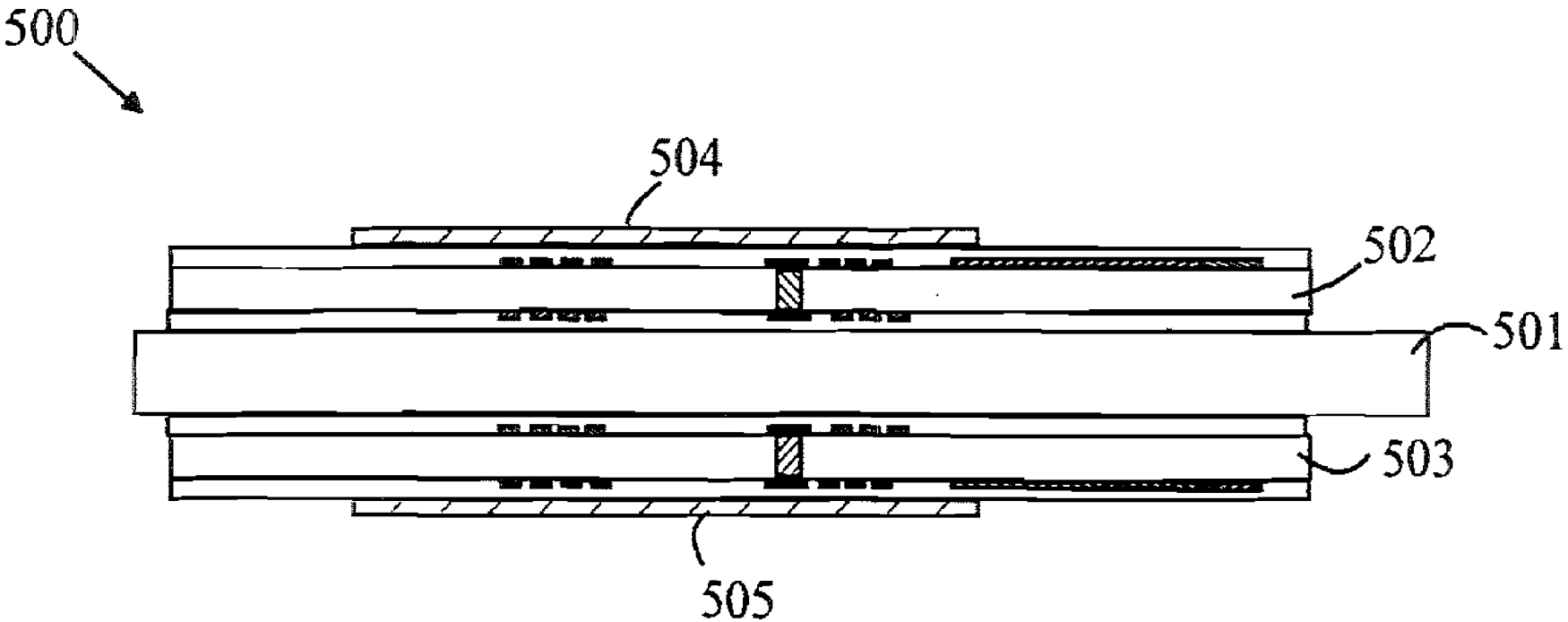
FIG. 26 is a cross-sectional view of another embodiment of a transformer according to the present invention.

Shielding can also be provided by providing a separate layer of a magnetic shielding material such mumetal on the outer surface of each transformer. Refer now to FIG. 26, which is a cross-sectional view of another embodiment of a transformer according to the present invention. Transformer 500 is constructed from two component coils 502 and 503 that are bonded to an insulating layer 501. A layer of magnetic shielding material 504 is provided on the outer surface of component coil 502. Similarly, a second layer of magnetic shielding material 505 is provided on the outer surface of component coil 503. While a layer of magnetic shielding material that is specifically designed to block the magnetic fields provides better shielding than a layer of a different magnetically active material, in some embodiments, the less effective magnetically active material may be preferred because of cost or ease of manufacture.

Figure 27:
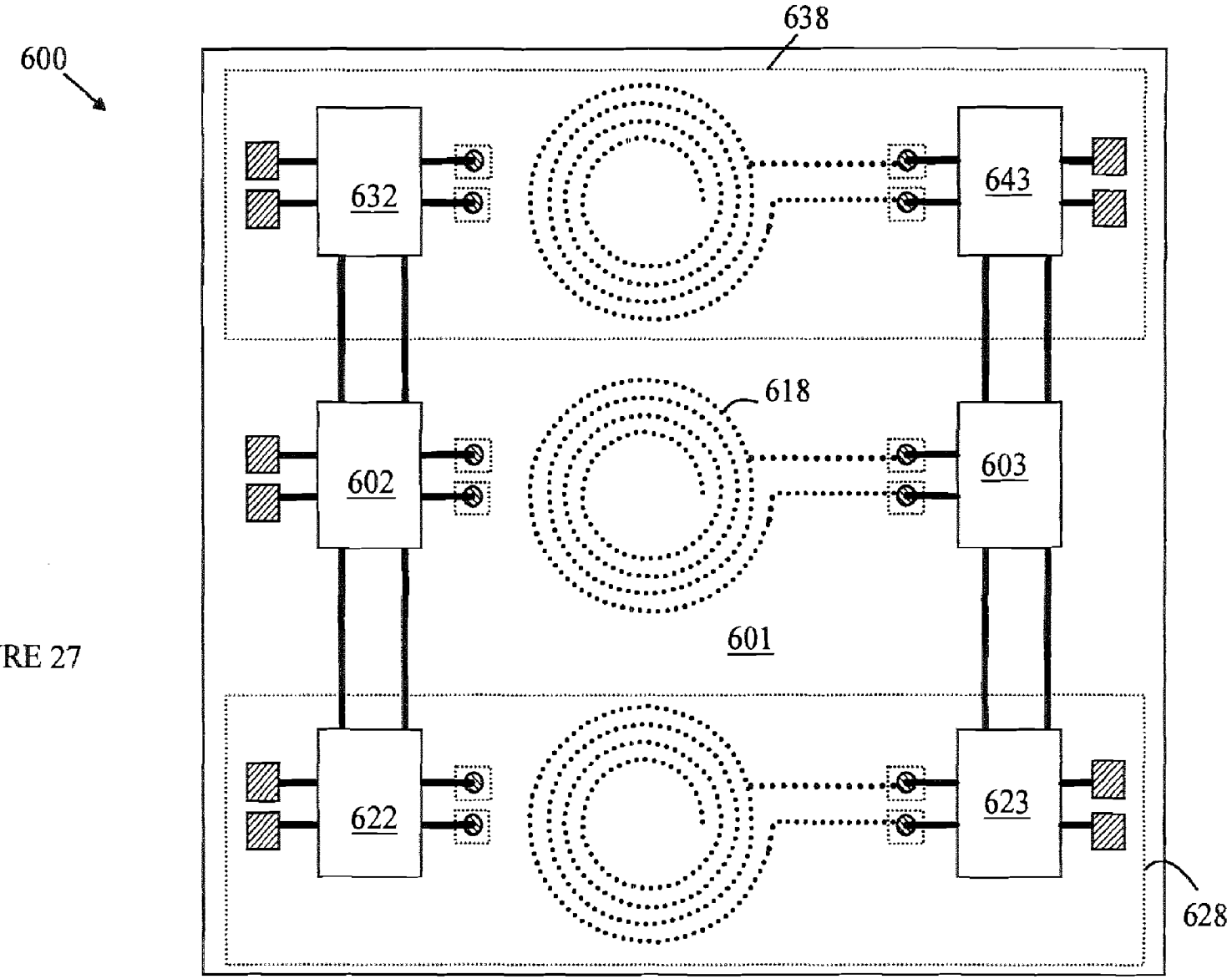
FIG. 27 is a top view of another embodiment of a galvanic isolator according to the present invention.

The galvanic isolators described above that utilize a transformer according to the present invention to provide power for one or more components in the isolator have utilized a single receiver and transmitter for the data path. However, galvanic isolators that include multiple data paths can also be constructed. Refer now to FIG. 27, which illustrates a galvanic isolator with two data paths and one power transformer. Galvanic isolator 600 includes a power section 601 that includes a power supply device 602 that includes an inverter for converting the DC power received on the bond pads to an AC signal that is applied to the primary winding of a transformer 618 according to the present invention. The secondary winding of transformer 618 is connected to a power converter that is included in device 603.

Galvanic converter 600 includes two data transmission sections shown at 628 and 638. Data transmission section 628 includes a transmitter 622 and a receiver 623. Data transmission section 638 includes a transmitter 643 and a receiver 632. Receiver 623 and transmitter 643 are powered from the power converter in device 603.

Various modifications to the present invention will become apparent to those skilled in the art from the foregoing description and accompanying drawings. Accordingly, the present invention is to be limited solely by the scope of the following claims.

What is claimed is:

1. A transformer comprising:

a primary winding;

a secondary winding;

N component coils;

wherein the N component coils are aligned such that a portion of a magnetic field generated by each component coil of the N component coils passes through at least one other component coil of the N component coils;

wherein a first electrically insulating material separates each component coil of the N component coils;

wherein the primary winding comprises odd numbered component coils of the N component coils;

wherein the secondary winding comprise even numbered component coils of the N component coils;

wherein the N component coils are vertically stacked starting with a number one component coil of the N component coils followed by sequently numbered component coils of the N component coils until the Nth component coil is stacked at a top of the N component coils;

wherein the odd numbered component coils of the primary winding are connected by a first vertical conductor;

wherein the even numbered component coils of the secondary winding are connected by a second vertical conductor;

wherein each component coil of the N component coils comprises:

a substrate comprising an second electrically insulting layer of material having top and bottom surfaces;

the top surface comprising a first trace having an outer end and an inner end and a first spiral conductor connected between the outer and inner ends of the first trace and comprising a continuous and gradually widening linear conductor that forms a curve around a central region; and the bottom surface comprising a second trace having an outer end and an inner end and a second spiral conductor connected between the outer and inner ends of the second trace and comprising a continuous and gradually widening linear conductor that forms a curve around a central region, the central regions of the first and second spiral conductors overlying one another;

a third vertical conductor connecting the inner ends of the first and second traces;

a first contact connected to the outer end of the first trace; and a second contact connected to the outer end of the second trace;

the first and second spiral conductors being oriented such that a current traveling from the outer end of the first trace to the inner end of the first race generates a magnetic field having a first component perpendicular to the top surface in the central region of the first trace, and such that a current passing surface in the central region of the first trace, and such that a current passing from the inner end of the second trace to the outer end of the second trace generates a magnetic field having a second component perpendicular to the top surface in the central region of the second trace, the first component having a direction that is the same as said second component.

2. The apparatus of claim 1 further comprising a first layer of magnetic shielding material and a second layer of magnetic shielding material, the first and second layers of magnetic shielding material being positioned to inhibit a magnetic field generated in the primary and secondary windings from extending beyond the transformer.

3. The apparatus of claim 1 wherein the first electrically insulating material is selected from the group consisting of glass, Kapton and a ceramic material.

4. The apparatus of claim 1 wherein each component coil of the N component coils further comprises a layer of magnetically-active material overlying the central region within the first spiral conductor, the layer of magnetically-active material not overlying the first spiral conductor.

5. The apparatus of claim 4 wherein the layer of magnetically-active material comprises ferrite.

* * * * *